US007309210B2

(12) United States Patent
Suciu et al.

(10) Patent No.: US 7,309,210 B2
(45) Date of Patent: Dec. 18, 2007

(54) TURBINE ENGINE ROTOR STACK

(75) Inventors: Gabriel L. Suciu, Glastonbury, CT (US); James W. Norris, Lebanon, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/016,453

(22) Filed: Dec. 17, 2004

(65) Prior Publication Data

US 2006/0130456 A1 Jun. 22, 2006

(51) Int. Cl.
*F01D 5/10* (2006.01)

(52) U.S. Cl. ..... 415/174.2; 415/196 R

(58) Field of Classification Search ..... 415/141, 415/174.2, 174.4; 416/52, 194, 195, 196 R
See application file for complete search history.

(56) References Cited

U.S. PATENT DOCUMENTS 2,470,780 A * 5/1949 Ledwith ..... 415/110
3,094,309 A 6/1963 Hull, Jr. et al.
3,295,825 A * 1/1967 Hall, Jr. ..... 416/221
3,642,383 A 2/1972 Andvig
4,645,416 A 2/1987 Weiner
4,655,683 A 4/1987 Chaplin
4,884,950 A 12/1989 Brodell et al.
5,267,397 A 12/1993 Wilcox
5,628,621 A 5/1997 Toborg
5,632,600 A * 5/1997 Hull ..... 416/198 A
6,082,967 A * 7/2000 Loisy ..... 416/129
6,672,966 B2 1/2004 Muju et al.

FOREIGN PATENT DOCUMENTS

FR 937533 A 8/1948

OTHER PUBLICATIONS

European Search Report for EP Patent Application No. 05257349.0

* cited by examiner

*Primary Examiner*—Edward K. Look
*Assistant Examiner*—Devin Hanan
(74) *Attorney, Agent, or Firm*—Bachman & LaPointe, P.C.

(57) ABSTRACT

A turbine engine has a first disk and a second disk, each extending radially from an inner aperture to an outer periphery. A coupling, transmits a torque and a longitudinal compressive force between the first and second disks. The coupling has first means for transmitting a majority of the torque and a majority of the force and second means, radially outboard of the first means, for vibration stabilizing.

26 Claims, 2 Drawing Sheets

TURBINE ENGINE ROTOR STACK

BACKGROUND OF THE INVENTION

The invention relates to gas turbine engines. More particularly, the invention relates to gas turbine engines having center-tie rotor stacks.

A gas turbine engine typically includes one or more rotor stacks associated with one or more sections of the engine. A rotor stack may include several longitudinally spaced apart blade-carrying disks of successive stages of the section. A stator structure may include circumferential stages of vanes longitudinally interspersed with the rotor disks. The rotor disks are secured to each other against relative rotation and the rotor stack is secured against rotation relative to other components on its common spool (e.g., the low and high speed/pressure spools of the engine).

Numerous systems have been used to tie rotor disks together. In an exemplary center-tie system, the disks are held longitudinally spaced from each other by sleeve-like spacers. The spacers may be unitarily-formed with one or both adjacent disks. However, some spacers are often separate from at least one of the adjacent pair of disks and may engage that disk via an interference fit and/or a keying arrangement. The interference fit or keying arrangement may require the maintenance of a longitudinal compressive force across the disk stack so as to maintain the engagement. The compressive force may be obtained by securing opposite ends of the stack to a central shaft passing within the stack. The stack may be mounted to the shaft with a longitudinal precompression force so that a tensile force of equal magnitude is transmitted through the portion of the shaft within the stack.

Alternate configurations involve the use of an array of circumferentially-spaced tie rods extending through web portions of the rotor disks to tie the disks together. In such systems, the associated spool may lack a shaft portion passing within the rotor. Rather, separate shaft segments may extend longitudinally outward from one or both ends of the rotor stack.

Desired improvements in efficiency and output have greatly driven developments in turbine engine configurations. Efficiency may include both performance efficiency and manufacturing efficiency.

U.S. patent application Ser. No. 10/825,255, Ser. No. 10/825,256, and Ser. No. 10/985,863 of Suciu and Norris (hereafter collectively the Suciu et al. applications, the disclosures of which are incorporated by reference herein as if set forth at length) disclose engines having one or more outwardly concave inter-disk spacers. With the rotor rotating, a centrifugal action may maintain longitudinal rotor compression and engagement between a spacer and at least one of the adjacent disks. This engagement may transmit longitudinal torque between the disks in addition to the compression.

SUMMARY OF THE INVENTION

One aspect of the invention involves a turbine engine having a first disk and a second disk, each extending radially from an inner aperture to an outer periphery. A coupling, transmits a torque and a longitudinal compressive force between the first and second disks. The coupling has first means for transmitting a majority of the torque and a majority of the force and second means, radially outboard of the first means, for vibration stabilizing of the first and second disks.

In various implementations, the second means may include spacers (e.g., as in the Suciu et al. applications or otherwise). The first means may comprise radial splines or interfitting first and second pluralities of teeth on the first and second disks, respectively. The first plurality of teeth may be formed at an aft rim of a first sleeve extending aft from and unitarily-formed with a web of the first disk. The second plurality of teeth may be formed at a forward rim of a second sleeve extending forward from and unitarily-formed with a web of the second disk. The first and second disks may each have an inboard annular protuberance inboard of the respective first and second sleeves. The second means may comprise a spacer having an outwardly longitudinally concave portion having a thickness and a longitudinal extent effective to provide an increase in said force with an increase in rotational speed of the first and second disks. The engine may have a high speed and pressure turbine section and a low speed and pressure turbine section. The first and second disks may be in the low speed and pressure turbine section. The engine may be a geared turbofan engine. A tension shaft may extend within the inner aperture of each of the first and second disks and be substantially nonrotating relative to the first and second disks. The engine may include a vane stage having a number of vane airfoils and having a sealing portion radially inboard of the vane airfoils for sealing with the coupling second means. A third disk may extend radially from an inner aperture to an outer periphery. A second coupling may transmit a torque and a longitudinal compressive force between the third and second disks. The second coupling may include first means for transmitting a majority of the torque and a majority of the force and second means, radially outboard of the first means, for vibration stabilizing. The engine may lack off-center tie members holding the first and second disks under longitudinal compression.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
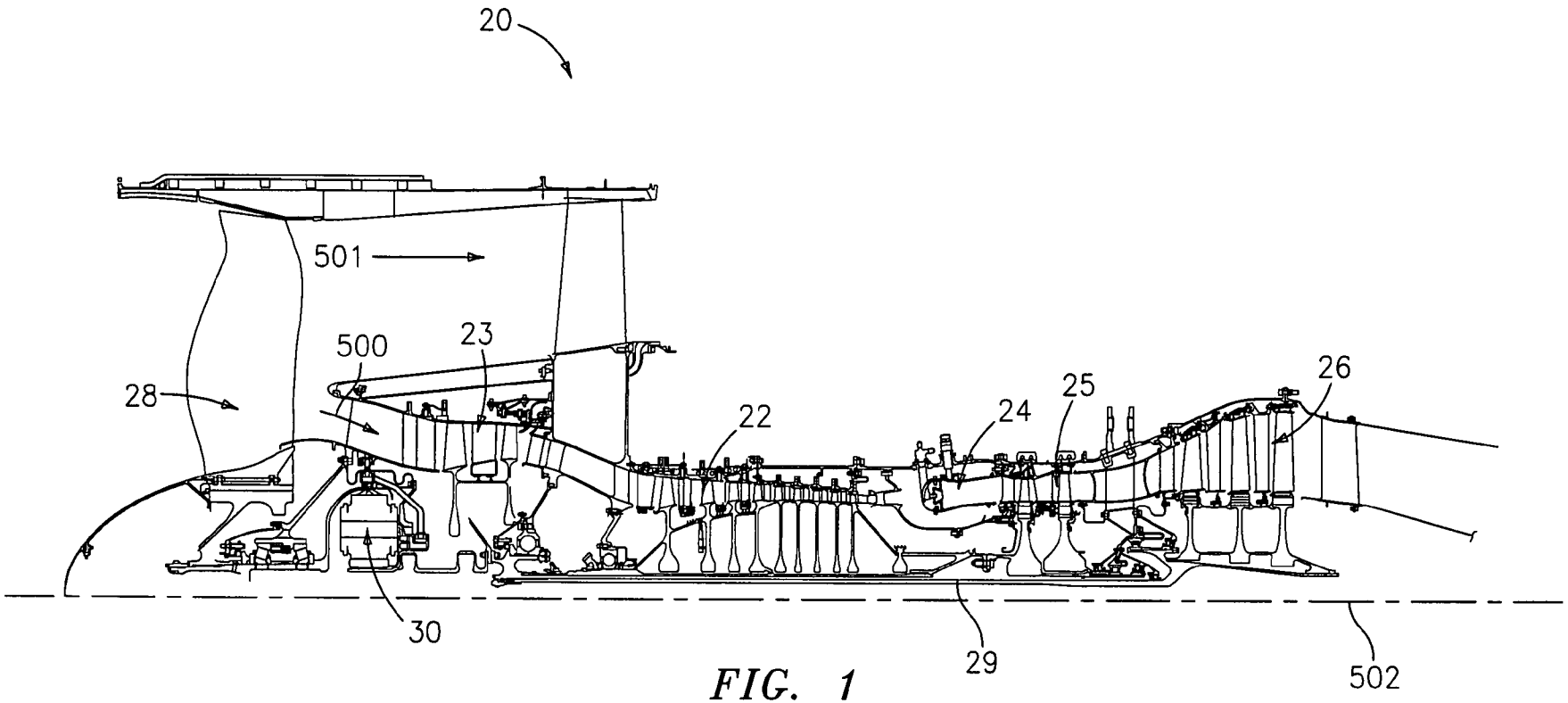
FIG. 1 is a partial longitudinal sectional view of a gas turbine engine.

FIG. 1 shows a gas turbine engine 20 having a high speed/pressure compressor (HPC) section 22 receiving air moving along a core flowpath 500 from a low speed/pressure compressor (LPC) section 23 and delivering the air to a combustor section 24. High and low speed/pressure turbine (HPT, LPT) sections 25 and 26 are downstream of the combustor along the core flowpath 500. The engine further includes a fan 28 driving air along a bypass flowpath 501. Alternative engines might include an augmentor (not shown) among other systems or features.

The exemplary engine 20 includes low and high speed spools mounted for rotation about an engine central longitudinal axis or centerline 502 relative to an engine stationary structure via several bearing systems. A low speed shaft 29 carries LPC and LPT rotors and their blades to form a low speed spool. The low speed shaft 29 may be an assembly, either fully or partially integrated (e.g., via welding). The low speed shaft is coupled to the fan 28 by an epicyclic transmission 30 to drive the fan at a lower speed than the low speed spool. The high speed spool includes the HPC and HPT rotors and their blades.

Figure 2:
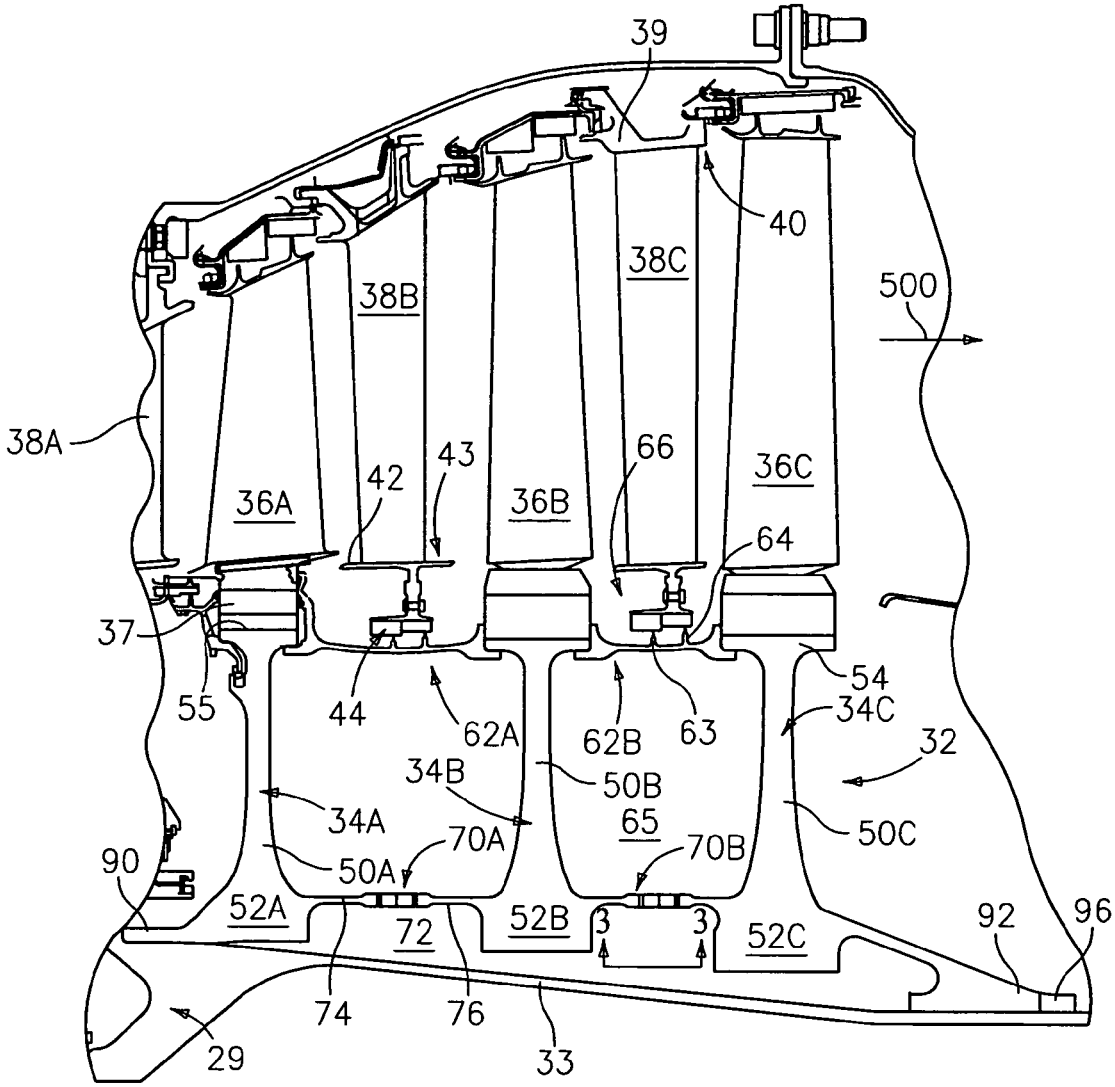
FIG. 2 is a partial longitudinal sectional view of a low pressure turbine rotor stack of the engine of FIG. 1.

FIG. 2 shows an LPT rotor stack 32 mounted to the low speed shaft 29 across an aft portion 33 thereof. The exemplary rotor stack 32 includes, from fore to aft and upstream to downstream, an exemplary three blade disks 34A-34C each carrying an associated stage of blades 36A-36C (e.g., by engagement of fir tree blade roots 37 to complementary disk slots). A plurality of stages of vanes 38A-38C are located along the core flowpath 500 sequentially interspersed with the blade stages. The vanes have airfoils extending radially inward from roots at outboard shrouds/platforms 39 formed as portions of a core flowpath outer wall 40. The vane airfoils extend inward to inboard platforms 42 forming portions of a core flowpath inboard wall 43. The platforms 42 of the second and third vane stages 38B and 38C have inwardly-extending flanges to which stepped honeycomb seals 44 are mounted (e.g., by screws or other fasteners).

In the exemplary embodiment, each of the disks 34A-34C has a generally annular web 50A-50C extending radially outward from an inboard annular protuberance known as a "bore" 52A-52C to an outboard peripheral portion 54 bearing an array of the fir tree slots 55. The bores 52A-52C encircle central apertures of the disks through which the portion 33 of the low speed shaft 29 freely passes with clearance. Alternative blades may be unitarily formed with the peripheral portions 54 (e.g., as a single piece with continuous microstructure) or non-unitarily integrally formed (e.g., via welding so as to only be destructively removable).

Outboard spacers 62A and 62B connect adjacent pairs of the disks 34A-34C. In the exemplary engine, the spacers 62A and 62B are formed separately from their adjacent disks. The spacers 62A and 62B may each have end portions in contacting engagement with adjacent portions (e.g., to peripheral portions 54) of the adjacent disks. Alternative spacers may be integrally with (e.g., unitarily formed with or welded to) one of the adjacent disks and extend to a contacting engagement with the other disk.

In the exemplary engine, the spacers 62A and 62B are outwardly concave (e.g., as disclosed in the Suciu et al. applications). The contacting engagement with the peripheral portions of the adjacent disks produces a longitudinal engagement force increasing with speed due to centrifugal action tending to straighten/flatten the spacers' sections. The exemplary spacers 62A and 62B have outboard surfaces from which one or more annular sealing teeth (e.g., fore and aft teeth 63 and 64) extend radially outward into sealing proximity with adjacent portions of the adjacent honeycomb seal 44.

The spacers 62A and 62B thus each separate an inboard/interior annular inter-disk cavity 65 from an outboard/exterior annular inter-disk cavity 66 (accommodating the honeycomb seal 44 and its associated mounting hardware).

Additional inter-disk coupling is provided between the disks 34A-34C. FIG. 2 shows couplings 70A and 70B radially inboard of the associated spacers 62A and 62B. The couplings 70A and 70B separate the associated annular inter-disk cavity 65 from an inter-disk cavity 72 between the adjacent bores. Each exemplary coupling 70A and 70B includes a first tubular ring-like structure 74 (FIG. 3) extending aft from the disk thereahead and a second such structure 76 extending forward from the disk aft thereof. The exemplary structures 74 and 76 are each unitarily-formed with their associated individual disk, extending respectively aft and forward from near the junction of the disk web and bore.

Figure 3:
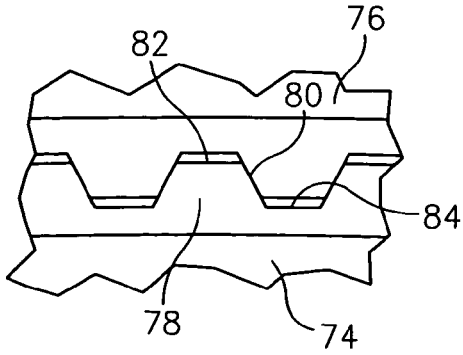
FIG. 3 is a radial view of interfitting splines of two disks of the stack of FIG. 2.

At respective aft and fore rims of the structures 74 and 76, the structures include interfitting radial splines or teeth 78 in a circumferential array (FIG. 3). The exemplary illustrated teeth 78 have a longitudinal span roughly the same as a radial span and a circumferential span somewhat longer. The exemplary teeth 78 have distally-tapering sides 80 extending to ends or apexes 82. In the exemplary engine, the sides 80 of each tooth contact the adjacent sides of the adjacent teeth of the other structure 74 or 76. In the exemplary engine, there is a gap between each tooth end 82 and the base 84 of the inter-tooth trough of the opposite structure. This gap permits longitudinal compressive force to reinforce circumferential engagement and maintain the two structures tightly engaged. Snap couplings or curvic couplings or other spline structures could be used instead of the exemplary spline structure.

In the exemplary engine, the couplings 70A and 70B transmit the majority of longitudinal compressive force and longitudinal torque along a primary compression path between their adjacent disks. A much smaller longitudinal force may be transmitted via the couplings 62A and 62B which may primarily serve to maintain position of and stabilize against vibration of the disks. A particular breakdown of force transmission may be dictated by packaging constraints. In the exemplary engine, the fore and aft ends of the LPT rotor engaging the shaft 29 are formed by fore and aft hubs 90 and 92 extending respectively fore and aft from the associated bores 52A and 52C. The relative inboard radial position of these hubs renders impractical a relatively outboard force transmission. An outward shifting of the hubs would increase longitudinal size and, thereby, create packaging and other problems. Thus, the couplings 70A and 70B are advantageously radially positioned near the connections of the disk bores 52A and 52C to the associated hubs 90 and 92.

The relative inboard position of the main compression and torque carrying couplings may provide design opportunities and advantages relative to alternate configurations. The use of geared turbofans has decoupled the design speed of the low speed spool from the design speed of the fan. This presents opportunities for increasing the speed of the low speed spool. Such increased speeds (e.g., typical operating speeds in the 9-10,000 rpm range) involve increased loading. To withstand increased loading, it may be desired to remove outboard weight such as outboard flanges and bolts that tie the disks together and transmit torque and/or force. A similar opportunity could be presented in the turbine section of the intermediate spool of a three-spool engine (e.g., wherein the fan is directly coupled to the low speed spool).

In the exemplary engine, the low speed shaft 29 is used as a center tension tie to hold the disks of the rotor 32 in compression. The disks may be assembled to the shaft 29 from fore-to-aft (e.g., first installing the disk 34A, then installing the spacer 62A, then installing the disk 34B, then installing the spacer 62B, then installing the disk 34C, and then compressing the stack and installing a locking nut or other element 96 (FIG. 2) to hold the stack precompressed).

Tightness of the rotor stack at the disk outboard peripheries may be achieved in a number of ways. Outward concavity of the spacers 62A and 62B may produce a speed-increasing longitudinal compression force along a secondary compression path through the spacers 62A and 62B. Additionally, the static conditions of the fore and aft disks 34A and 34C may be slightly dished respectively forwardly and aft. With rotation, centrifugal action will tend to straighten/undish the disks 34A and 34C and move the peripheral portions 54 of the disks 34A and 34C longitudinally inward (i.e., respectively aft and forward). This tendency may counter the effect on and from the spacers 62A and 62B so as to at least partially resist their flattening. By at least partially resisting this flattening, good sealing with the honeycomb seals 44 may be achieved across a relatively wide speed range.

The foregoing principles may be applied in the reengineering of an existing engine configuration or in an original engineering process. Various engineering techniques may be utilized. These may include simulations and actual hardware testing. The simulations/testing may be performed at static conditions and one or more non-zero speed conditions. The non-zero speed conditions may include one or both of steady-state operation and transient conditions (e.g., accelerations, decelerations, and combinations thereof). The simulation/tests may be performed iteratively. The iteration may involve varying parameters of the spacers 62A and 62B such as spacer thickness, spacer curvature or other shape parameters, vane seal shape parameters, and static seal-to-spacer separation (which may include varying specific positions for the seal and the spacer). The iteration may involve varying parameters of the couplings 70A and 70B such as the thickness profiles of the structures 74 and 76, the size and geometry of the teeth 78, the radial position of the couplings, and the like.

One or more embodiments of the present invention have been described. Nevertheless, it will be understood that various modifications may be made without departing from the spirit and scope of the invention. For example, when applied as a reengineering of an existing engine configuration, details of the existing configuration may influence details of any particular implementation. Accordingly, other embodiments are within the scope of the following claims.

What is claimed is:

1. A turbine engine comprising:

a first disk and a second disk, each extending radially from an inner aperture to an outer periphery; and a coupling, transmitting a torque and a longitudinal compressive force between the first and second disks and comprising:

first means for transmitting a majority of the torque and a majority of the force; and second means, radially outboard of the first means, for vibration stabilizing of the first and second disks; said second means comprising an unsegmented spacer.

2. The engine of claim 1 wherein:

the first means comprise interfitting first and second pluralities of teeth on the first and second disks, respectively.

3. The engine of claim 2 wherein:

the first plurality of teeth is at an aft rim of a first sleeve extending aft from and unitarily-formed with a web of the first disk;

the second plurality of teeth is at a forward rim of a second sleeve extending forward from and unitarily-formed with a web of the second disk; and the first and second disks each have an inboard annular protuberance inboard of the respective first and second sleeves.

4. The engine of claim 2 wherein:

the spacer has an outwardly longitudinally concave portion having a thickness and a longitudinal extent effective to provide an increase in a longitudinal force across the spacer with an increase in rotational speed of the first and second disks.

5. The engine of claim 1 wherein:

the first and second means and a central tension shaft provide essentially the only structural coupling between the first and second disks.

6. The engine of claim 1 wherein:

the engine has a low speed and pressure turbine section and a high speed and pressure turbine section; and the first and second disks are in the low speed and pressure turbine section.

7. The engine of claim 6 wherein:

the engine is a geared turbofan engine.

8. The engine of claim 1 further comprising:

a tension shaft extending within the inner aperture of each of the first and second disks and substantially nonrotating relative to the fist and second disks.

9. The engine of claim 1 further comprising a vane stage between the first and second disks and wherein:

the vane stage has a plurality of vane airfoils; and the vane stage has a sealing portion radially inboard of the vane airfoils for sealing with the coupling second means.

10. The engine of claim 1 further comprising:

a third disk, extending radially from an inner aperture to an outer periphery; and a second coupling, transmitting a torque and a longitudinal compressive force between the third and second disks and comprising:

first means for transmitting a majority of the torque and a majority of the force; and second means, radially outboard of the first means for vibration stabilizing of the first and second disks.

11. The engine of claim 1 wherein:

there is no circumferential array of off-center tie members holding the first and second disks under longitudinal compression.

12. The engine of claim 1 wherein:

there are no fasteners directly securing the first and second disks.

13. A gas turbine engine comprising:

a central shaft;

a plurality of blade disks, the disks each having a central aperture surrounding the shaft, and the disks defining annular cavities between adjacent pairs of the disks;

a plurality of vane stages interspersed with the blade disks;

a radial spline torque coupling between a first and a second of said disks; and a spacer having:

a longitudinally cross-sectional profile having an outward concavity effective to provide an increase in a longitudinal force across the spacer with an increase in rotational speed of the first and second disks; and at least one radially outwardly extending sealing element for sealing with one of the vane stages.

14. The engine of claim 13 further comprising:

a honeycomb sealing means on said one of the vane stages for sealing with the sealing element.

15. The rotor of claim 13 wherein:

the first and second disks are turbine section disks.

16. The rotor of claim 13 wherein:

the engine is a geared turbofan engine.

17. A turbine engine rotor comprising:

a plurality of disks, each disk extending radially from an inner aperture to an outer periphery;

a plurality of stages of blades, each stage borne by an associated one of said disks;

a plurality of stages of vanes interspersed with said stages of blades;

a plurality of spacers, each spacer between an adjacent pair of said disks; and a central shaft carrying the plurality of disks and the plurality of spacers to rotate about an axis with the plurality of disks and the plurality of spacers, wherein:

a first of the spacers in longitudinal compression between a first and a second of the disks has first means for sealing with second means of an adjacent one of said stages of vanes; and interfitting first and second portions of said first and second disks radially inboard of said first spacer transmit longitudinal force and torque between the first and second disks.

18. The rotor of claim 17 wherein:

the interfitting first and second portions comprise radial splines.

19. The rotor of claim 17 wherein:

the first spacer is separately formed from the first and second disks; and the first spacer has first and second end portions essentially interference fit within associated portions of the first and second disks, respectively.

20. The rotor of claim 17 in combination with a stator and wherein:

the first spacer has a longitudinal cross-section, said longitudinal cross-section having a first portion being essentially outwardly concave in a static condition, said first means extending radially outward from said first portion; and said second means comprises a honeycomb material.

21. A turbine engine comprising:

a first disk and a second disk, each extending radially from an inner aperture to an outer periphery; and a coupling, transmitting a torque and a longitudinal compressive force between the first and second disks and comprising:

first means for transmitting a majority of the torque and a majority of the force and comprising interfitting first and second pluralities of teeth on the first and second disks, respectively; and second means, radially outboard of the first means, for vibration stabilizing of the first and second disks and comprising a spacer having an outwardly longitudinally concave portion having a thickness and a longitudinal extent effective to provide an increase in a longitudinal force across the spacer with an increase in rotational speed of the first and second disks.

22. The engine of claim 21 wherein:

the first plurality of teeth is at an aft rim of a first sleeve extending aft from and unitarily-formed with a web of the first disk;

the second plurality of teeth is at a forward rim of a second sleeve extending forward from and unitarily-formed with a web of the second disk; and the first and second disks each have an inboard annular protuberance inboard of the respective first and second sleeves.

23. A turbine engine rotor comprising:

a plurality of disks, each disk extending radially from an inner aperture to an outer periphery;

a plurality of stages of blades, each stage borne by an associated one of said disks;

a plurality of stages of vanes interspersed with said stages of blades;

a plurality of spacers, each spacer between an adjacent pair of said disks; and a central shaft carrying the plurality of disks and the plurality of spacers to rotate about an axis with the plurality of disks and the plurality of spacers, wherein:

a first of the spacers between a first and a second of the disks has first means for sealing with second means of an adjacent one of said stages of vanes;

interfitting first and second portions of said first and second disks radially inboard of said first spacer transmit longitudinal force and torque between the first and second disks;

the first spacer has a longitudinal cross-section, said longitudinal cross-section having a first portion being essentially outwardly concave in a static condition, said first means extending radially outward from said first portion; and said second means comprises a honeycomb material.

24. The rotor of claim 23 wherein:

the interfitting first and second portions comprise radial splines.

25. The rotor of claim 23 wherein:

the first spacer is separately formed from the first and second disks; and the first spacer has first and second end portions essentially interference fit within associated portions of the first and second disks, respectively.

26. A turbine engine rotor comprising:

a plurality of disks, each disk extending radially from an inner aperture to an outer periphery;

a plurality of stages of blades, each stage borne by an associated one of said disks;

a plurality of stages of vanes interspersed with said stages of blades;

a plurality of spacers, each spacer between an adjacent pair of said disks; and a central shaft carrying the plurality of disks and the plurality of spacers to rotate about an axis with the plurality of disks and the plurality of spacers, wherein:

a first of the spacers between a first and a second of the disks has first means for sealing with second means of an adjacent one of said stages of vanes and has first and second end portions essentially interference fit radially within associated portions of the first and second disks, respectively; and interfitting first and second portions of said first and second disks radially inboard of said first spacer transmit longitudinal force and torque between the first and second disks.

* * * * *

UNITED STATES PATENT AND TRADEMARK OFFICE

CERTIFICATE OF CORRECTION

PATENT NO. : 7,309,210 B2
APPLICATION NO. : 11/016453
DATED : December 18, 2007
INVENTOR(S) : Gabriel L. Suciu et al.

It is certified that error appears in the above-identified patent and that said Letters Patent is hereby corrected as shown below:

In column 6, claim 8, line 21, delete “fist” and insert --first--.

Signed and Sealed this

Fourth Day of November, 2008

JON W. DUDAS
*Director of the United States Patent and Trademark Office*